US006374583B1

(12) United States Patent
Daelmans et al.

(10) Patent No.: US 6,374,583 B1
(45) **Date of Patent: *Apr. 23, 2002**

(54) WRAPPER CLOSED BY TWIST WRAPS AND WRAPPING METHOD

(75) Inventors: Eddy Daelmans, Dislen-Stokkem; Raymond Vanoppre, Diest, both of (BE)

(73) Assignee: Transpac, N.V., Brussels (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/284,343

(22) PCT Filed: Sep. 23, 1997

(86) PCT No.: PCT/EP97/05256

§ 371 Date: Jun. 11, 1999

§ 102(e) Date: Jun. 11, 1999

(87) PCT Pub. No.: WO98/15470

PCT Pub. Date: Apr. 16, 1998

(30) Foreign Application Priority Data

Oct. 8, 1996 (EP) ..... 96202789

(51) Int. Cl.[7] ..... B65B 7/12; B32B 23/02

(52) U.S. Cl. ..... 53/483; 53/463; 53/370; 428/194; 428/192

(58) Field of Search ..... 53/461, 483, 377.4, 53/376.5, 373.3, 463, 370; 428/194, 192, 195, 196; 229/87.01

(56) References Cited

U.S. PATENT DOCUMENTS

| | | | | | |
|---|---|---|---|---|---|
| 808,520 | A | * | 12/1905 | Driskell | 493/276 |
| 1,044,948 | A | * | 11/1912 | Ulmer | 206/272 |
| 1,208,828 | A | * | 12/1916 | Planco | 206/272 |
| 2,185,470 | A | | 1/1940 | MacDonald et al. | 229/37 |
| 2,342,977 | A | * | 2/1944 | Snyder | 53/463 |
| 2,545,243 | A | * | 3/1951 | Rumsey | 206/497 |
| 2,676,897 | A | * | 4/1954 | Trillich | 428/211 |
| 3,111,796 | A | * | 11/1963 | Meissner | 53/483 |
| 3,352,085 | A | * | 11/1967 | Pantenburg | 53/376.5 |
| 3,964,669 | A | * | 6/1976 | Sontag et al. | 229/40 |
| 5,414,976 | A | * | 5/1995 | Richards | 53/449 |
| 5,510,124 | A | * | 4/1996 | Kopecky et al. | 53/466 |
| 5,518,119 | A | * | 5/1996 | Takahashi | 53/442 |
| 5,722,585 | A | * | 3/1998 | Redl | 53/377.4 |
| 5,935,686 | A | * | 8/1999 | Daelmans et al. | 53/390 |
| 5,974,765 | A | * | 11/1999 | Weder et al. | 53/397 |
| 5,975,299 | A | * | 11/1999 | Weder et al. | 206/423 |

FOREIGN PATENT DOCUMENTS

| | | |
|---|---|---|
| CH | 255279 | 1/1949 |
| FR | 2262630 | 9/1975 |
| GB | 666501 | 2/1952 |
| GB | 1096058 | 12/1967 |

* cited by examiner

*Primary Examiner*—S. Thomas Hughes
*Assistant Examiner*—Marc Jimenez
(74) *Attorney, Agent, or Firm*—Leydig, Voit and Mayer, Ltd.

(57) ABSTRACT

A packaging wrapper consisting of a film intended to be closed by two twists on either side of an article to be packaged, characterized in that the film comprises, on the internal side in relation to the article to be packaged, a sealing coating placed along two transverse strips on either side of the article to be packaged and extending parallel to an axis passing through the two twists. The film may additionally comprise two lengthwise strips of sealing coating extending on either side of the strips of sealing coating extending on either side of the article to be packaged, perpendicularly to the said transverse strips in the regions of formation of the twists. These sealing coatings may be either cold-sealing coatings or heat-sealing coatings.

10 Claims, 5 Drawing Sheets

WRAPPER CLOSED BY TWIST WRAPS AND WRAPPING METHOD

CROSS-REFERENCES TO RELATED APPLICATIONS

This application claims the benefit of International Application No. PCT/EP97/05256, which claims priority from European Application No. EP96202789.2 filed Oct. 8, 1996.

FIELD OF THE INVENTION

The present invention relates to a packaging wrapper consisting of a film intended to be closed by two twists on either side of an article to be packaged, and to a process for packaging an article with the aid of such a package. In particular, the invention relates to the field of the packaging of confectionery products.

BACKGROUND OF THE INVENTION

Confectionery are generally packaged individually in a preprinted piece of film of an appropriate size and shape, it being possible for the said individually packaged products to be, in their turn, packed in bulk in a small packaging bag of an appropriate size. The article to be packaged is typically first of all completely wrapped in a rectangular piece of film and the package thus formed is closed by twists at two points situated on either side of the article to be packaged.

In the context of the present invention a twist is intended to mean the result of the closure by twining of the said wrapper.

An important problem which presents itself in this respect is that of the retention of the twist. This retention can be obtained only at the cost of a particular selection of the film employed as substrate, which must exhibit appropriate mechanical characteristics such as pliability or, in particular, a pronounced tendency not to return to its initial position after the twining of the said film.

In particular, this problem becomes apparent when articles of small sizes and of essentially round section are being packaged, such as confectionery products like, for example, bonbons, lollipops, barley sugar, fruit jellies, chocolate-coated bars or else more bulky products such as bottles, rolls of articles, etc.

As solution, it is known to select particular substrates which are known for their high pliability, like waxed paper or cellophane or synthetic films containing an appropriate quantity of an additive increasing the pliability of the said substrate.

This solution considerably restricts the potential choices of films employed as packaging substrate and considerably increases their cost.

Packages closed by twists, which are produced from substrates precoated with a heat-sealing coating, are known on the market. When twists are being formed at the ends of the wrapper containing the article to be packaged, a source of heat at a temperature of approximately between 120 and 160° C. is approached for a certain period of time. In general, it is the jaws performing the twining that are heated, but it is also possible to blow hot air by means of a pipe of appropriate size onto the said twists, and this results in the melting of the heat-sealing coating and the sealing of the twist thus formed when the said heat-sealing coating is cooled.

Document GB-A-1096058 proposes a film with a cold-sealing coating which exhibits an excellent retention after closure of the wrapper by twining of the twists. This cold-sealing coating is in the form of two lengthwise strips situated in the regions of formation of the twists on either side of the article to be packaged.

Cold-sealing is intended to mean sealing which takes place instantaneously merely by contact at a temperature of approximately between 0 and 50° C. In reality, the temperature is not a critical parameter for obtaining sealing by means of a cold-sealing coating and has practically no effect on the quality of the sealing obtained. The sealing is therefore performed without an additional heat input being necessary at the ambient temperature of the space in which the packaging unit is situated.

This method therefore makes it possible to employ films which are less expensive and have better properties (rigidity, printability, aesthetic qualities) for the packaging of articles without any restrictions as to the shape or the heat-sensitivity of the said articles.

SUMMARY OF THE INVENTION

The objective of the present invention is to provide a novel packaging of the type with closure by twists, which allows a better closure than the currently known packages, as well as a novel packaging process.

To attain this objective the present invention provides a packaging wrapper consisting of a film intended to be closed by two twists on either side of an article to be packaged, characterized in that the film comprises, on the internal side in relation to the article to be packaged, a sealing coating placed along two transverse strips on either side of the article to be packaged and extending parallel to an axis passing through the two twists.

The said sealing coating may be a cold-sealing coating or a heat-sealing coating.

The film may additionally comprise two lengthwise strips of sealing coating extending on either side of the strips of sealing coating extending on either side of the article to be packaged, perpendicularly to the said transverse strips in the regions of formation of the twists. These sealing coatings may also be either cold-sealing coatings or heat-sealing coatings. When the substrate of the film has a low resistance to elevated temperatures and/or when the article to be packaged is heat-sensitive, especially products of chocolate manufacture, the cold-sealing coating deserves to be preferred.

The heat-sealing coating may be a layer of PE (polyethylene) coextruded onto OPP (oriented polypropylene).

As cold-sealing coating, it is possible to envisage pressure-sensitive adhesives, which are substances which are continually adhesive and which adhere spontaneously to the surface of most materials under the effect of a simple moderate pressure.

As a general rule the pressure-sensitive adhesives are compositions based on natural and/or synthetic rubber, used in combination with modified cellophanes, phenol-formaldehyde resins or hydrocarbon resins (waxes). Besides rubbers, polymers based on styrene, (meth)acrylic acid or vinyl ether are widely employed, alone or as a mixture, also in combination with resins. Lastly, silicone resins may also be employed. Compositions including mixtures of natural and synthetic rubbers and copolymers of (meth)acrylic acid and styrene are preferably employed.

These cold-sealing coatings are deposited onto the substrate at a rate of approximately from 1 to 5 g/m$^2$. They can be applied in the form of solution or dispersion or even in the molten state. Coating deposition techniques which are well known to a person skilled in the art may be employed, such as, for example, heliographic or flexographic printing or else offset printing.

The invention also proposes a process for packaging an article in a film comprising at least two transverse strips of a sealing coating, according to which the article is deposited on the film on the side of the said strips and between the latter, the two sections which are provided with the said strips of coating are raised substantially vertically, the two sections are brought close on top of the article and their edges are sealed to one another, the two edges thus sealed are folded back over the article and the projections of the film extending beyond on either side of the article are twined to form two twists.

When the strips of coating comprise a cold-sealing coating, the operation of folding and sealing the edges of the strips on top of the article is preferably carried out as a single operation between the jaws of a press.

When the coating is a heat-sealing coating, the edges are sealed to each other by a heat-sealing process.

The invention has the advantage that, for the first time, the package of the twist-closure type is sealed in the transverse direction between the two twists. Given that even the packages without lengthwise coating in the regions of formation of the twists have a leakproofing which is rather good at the twists, packages which are completely closed are thus produced.

With regard to the packages provided with lengthwise regions of heat- or cold-coating, in the case of which there is a leakproof closure at the twists, a virtually hermetic closure is produced by virtue of the transverse sealing. This complete closure of the package is very advantageous with regard to the conservation of the articles, since it prevents the entry of moisture, of gas, of air or of other harmful substances and, at the same time, preserves the flavours within the packaging.

The invention will be understood better on reading the description of a few embodiments which are presented below, by way of illustration, with reference to the attached drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
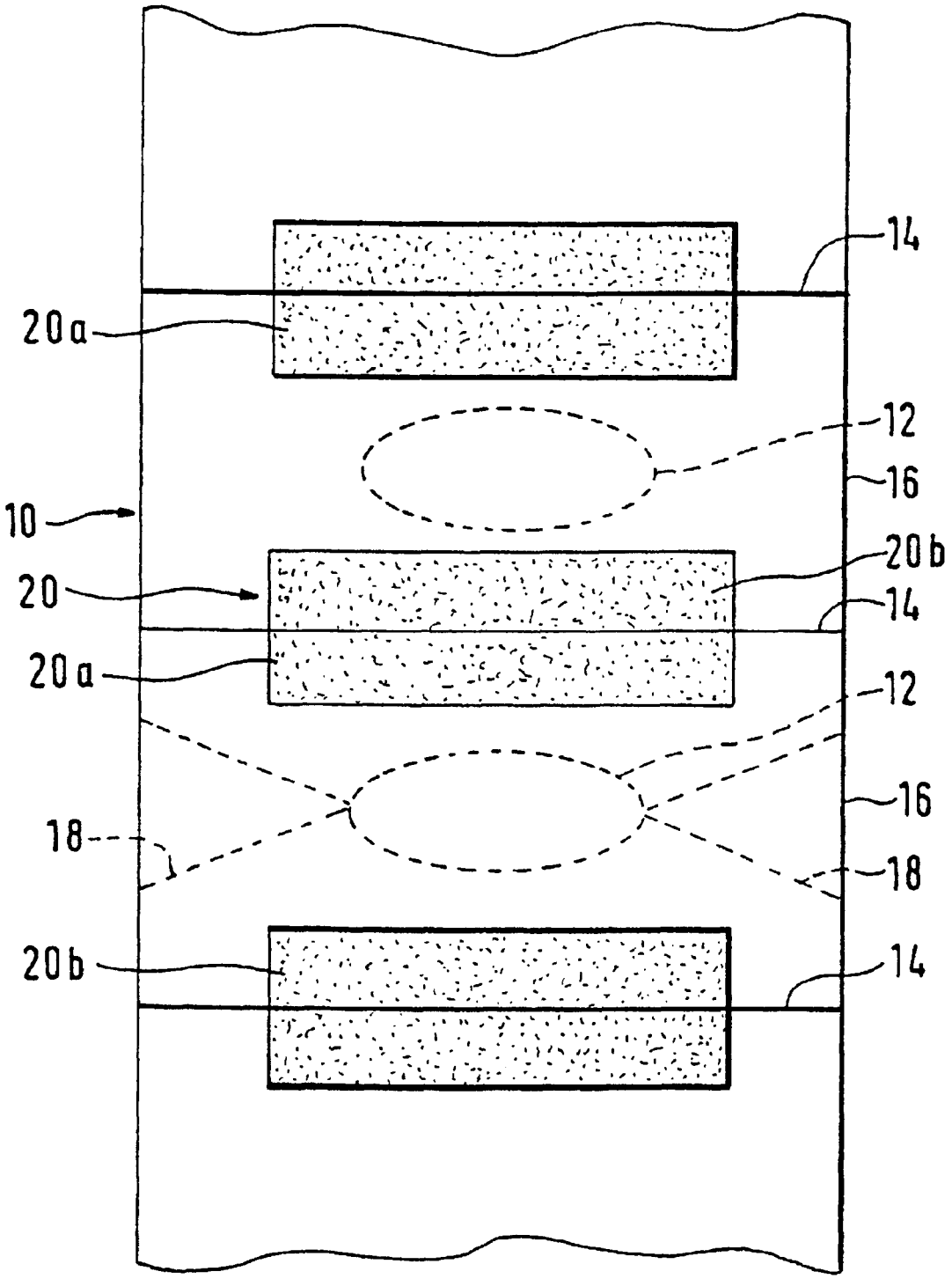
FIG. 1 shows diagrammatically a plan view of a first embodiment of a package according to the present invention.

FIG. 1 shows a strip of film indicated overall by reference 10, which is a film with a good retention where the twining alone suffices to obtain a rigid twist which does not open, that is to say a substrate which does not require an adhesive bonding coating for retaining the twists. Such a film may, for example, be a cellophane film, a cast PP (cast polypropylene) film, waxed paper, an aluminum/OPP laminate and the like.

The articles to be packaged are shown using broken lines by reference 12. The strip of film 10 is intended to be cut along the lines 14 to provide pieces of film 16 which are identical with each other, which act as packaging wrappers for the articles 12. The outline of the twists 18 obtained by twining the projections on either side of the article to be packaged 12 has also been shown using broken lines in FIG. 1.

In accordance with the present invention the strip of film 10 comprises sealing coatings 20 extending in the transverse direction of the strip on the internal side in relation to the articles 12 to be packaged. These strips 20 are placed straddling the cut lines 14 so that after cutting of the strip of film 10 each individual piece 16 comprises two transverse strips 20*a,* 20*b* of sealing coating along its edges.

In the example shown in FIG. 1 the sealing coating is a cold-sealing coating, for example the product 22-392 of the company Croda, which is deposited at a rate of 3 $g/m^2$.

Figure 2:
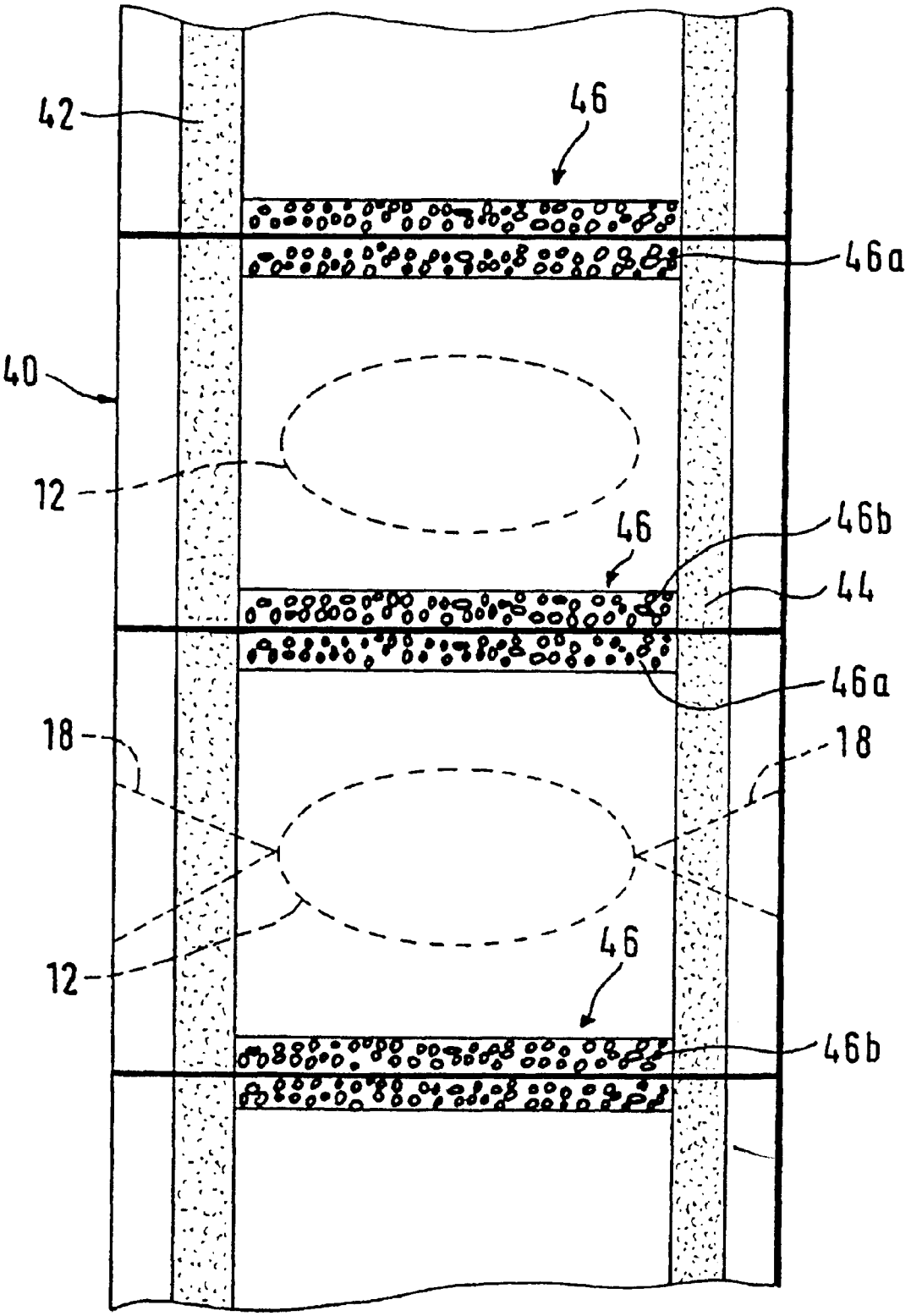
FIG. 2 shows diagrammatically a plan view of a second embodiment of a package according to the present invention.

FIG. 2 shows a second embodiment of a packaging film 40 according to the present invention. This film 40 consists of coexOPP (coextruded oriented polypropylene) which on its own does not have any properties of retention of the twists 18. Nevertheless, to make it possible to form these twists 18 the film is coated in the two regions of formation of the twists 18, on the internal side in relation to the product to be packaged 12, with two lengthwise strips 42, 44 of a cold-sealing coating which may consist of the same material as that of the transverse strips 20 of the embodiment of FIG. 1. The embodiment of FIG. 2 comprises transverse strips 46 of heat-sealing coating which form transverse strips 46*a* and 46*b* along the edges of each piece after the film has been cut. These transverse strips of heat-sealing coating may be formed by a layer of PE coextruded onto the OPP.

It should be noted that various combinations are possible between the embodiments according to FIGS. 1 and 2. Thus, for example, the transverse strips of cold-sealing coating of FIG. 1 may be replaced by transverse strips of heat-sealing coating. Similarly, the heat-sealing strips 46 in FIG. 2 may be replaced by cold-sealing strips. Furthermore, it is possible that both the lengthwise strips 42, 44 in FIG. 2 and the transverse strips 46 may all consist either of heat-sealing coating or of cold-sealing coating.

Figures 3A, 3B, 3C, 3D:
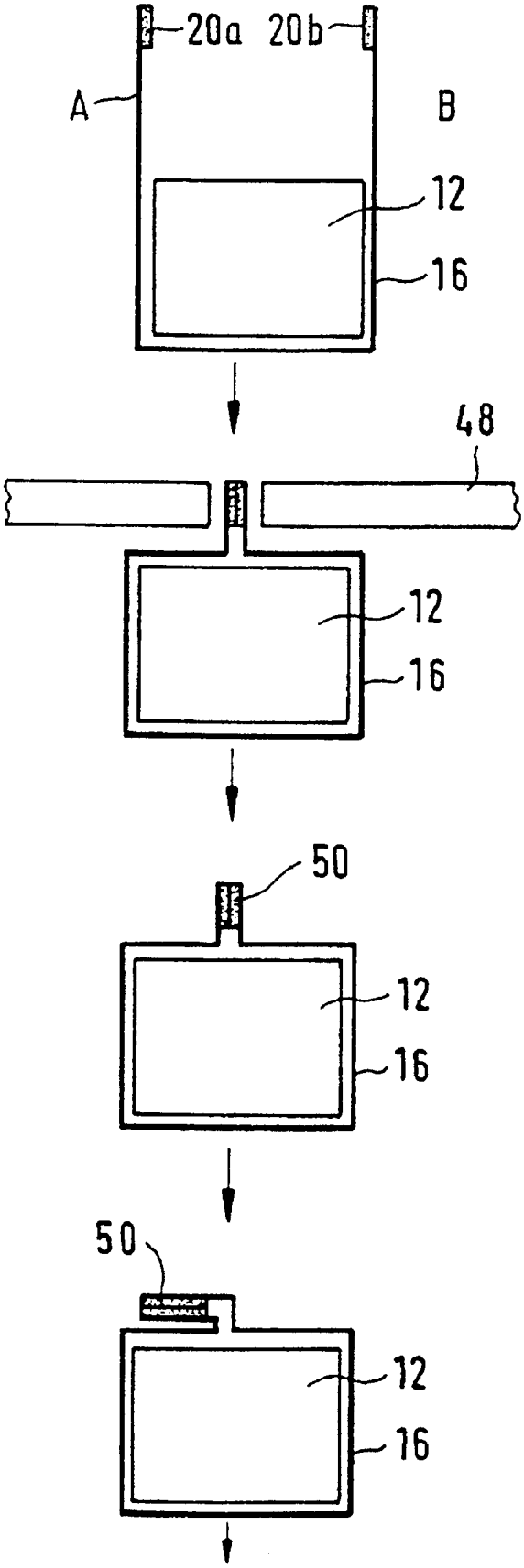
FIGS. 3*a,* 3*b,* 3*c* and 3*d* show the successive sequences of packaging of an article with the aid of a package according to the present invention.
Figure 4A:
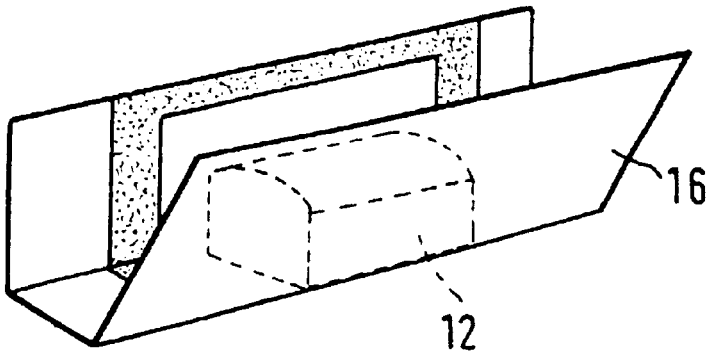
FIGS. 4*a,* 4*b,* 4*c* and 4*d* show, in perspective views, the various sequences of packaging.
Figure 4B:
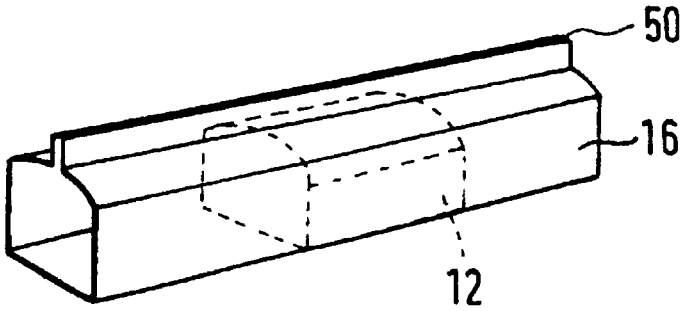
Figure 4C:
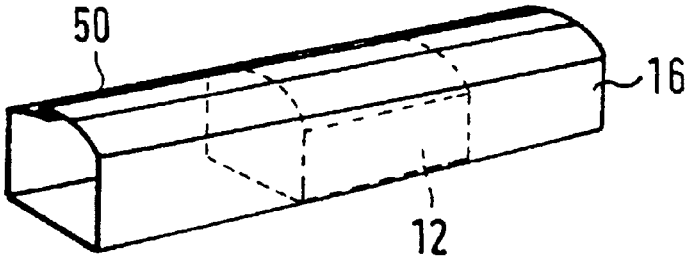
Figure 4D:
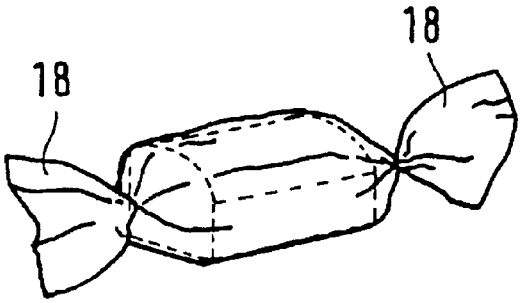
Figure 5:
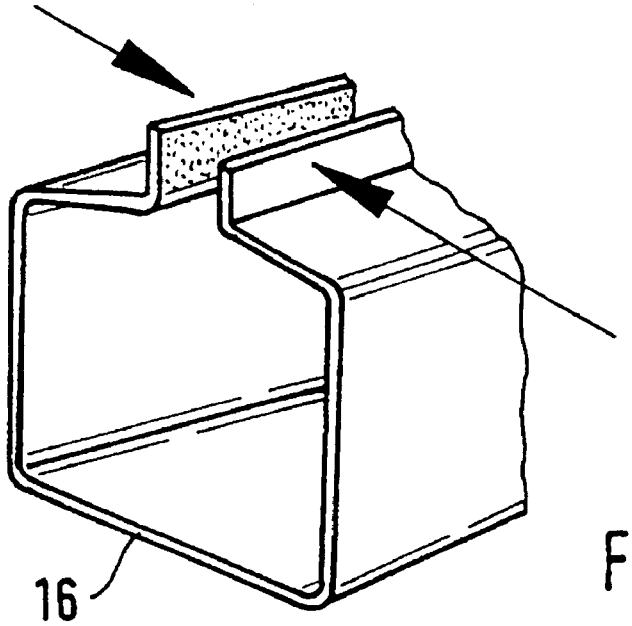
FIGS. 5 and 6 show the sealing and the folding of the packaging according to the present invention in the transverse direction parallel to the axis passing through the twists.
Figure 6:
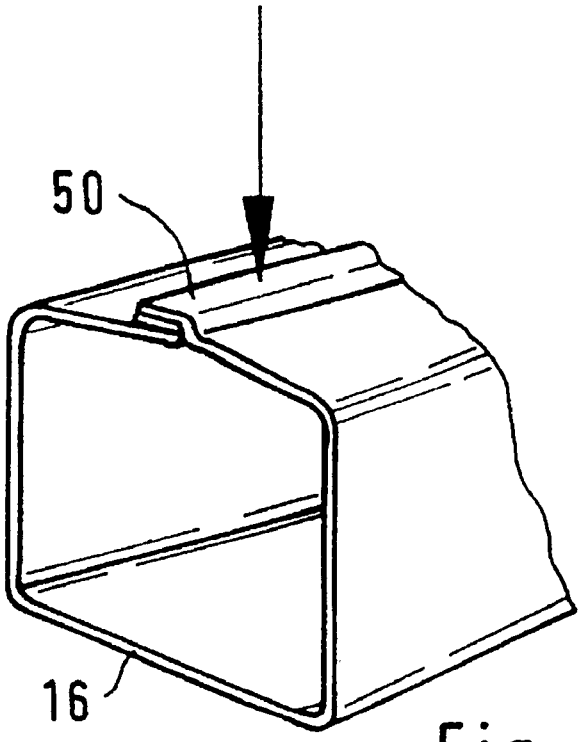

FIGS. 3*a* to 3*d* and FIGS. 4*a* to 4*d* illustrate the various successive stages of a process of packaging in accordance with the present invention with the aid of a package as described above with reference to FIGS. 1 or 2. The article 12 is placed on one of the film foils 16 within the transverse strips 20*a* and 20*b*. The pieces of film 16 of FIG. 1 have been shown, by way of example, in the figures, but it is to be understood that the process applies equally well to the film of FIG. 2 and to the various possible combinations. The two side sections A and B with the transverse strips of sealing coating 20*a* and 20*b* are next folded upwards as shown in FIGS. 3*a* and 4*a*. The two sections A and B are next folded simultaneously inwards over the article 12 so that their internal edges with the transverse strips 20*a* and 20*b* are placed against one another as shown in FIG. 4*b*. A pressure is next exerted, as shown in FIG. 5, on the outside of each of the edges of the sections A and B over the whole width in order to seal these two sections well together at their cold-sealing coating. This operation of folding the sections A and B and of sealing their edge may be performed as a single operation between the jaws of a press 48 (FIG. 3*b*). A sealing rib 50 is thus obtained, which extends over the whole width, as shown in FIGS. 3*c* and 4*b*. This rib is next folded and folded back over the package according to FIGS. 3*d* and 4*c*, preferably, by applying a vertical pressure according to FIG. 6 to give the package an attractive presentation. The package is finished by twining the two ends in the direction of the folding back of the rib 50 to form two twists 18 according to FIG. 4*d*.

By virtue of the presence of the transverse strips 20*a*, 20*b* of cold-sealing coating and by virtue of the use of pressure, a perfect closure is obtained over the whole width of the package. In addition, the twists 18 ensure a side closure, above all when they are made at the lengthwise strips 42 and 44 of sealing coating according to FIG. 2. A virtually hermetic package is thus produced, which prevents the exit of the flavours or the entry of air, of moisture, of detrimental odours and the like.

In the case of transverse strips of heat-sealing coating the jaws of the press 48 may be heated to a temperature of the order of 150° to obtain perfect sealing between the strips 20*a* and 20*b*. It is also possible to blow hot air (±150–180° C.) onto the two edges before they are sealed together in the press.

What is claimed is:

1. A process for packaging an article in foils of a film, each foil extending in longitudinal and transverse directions and having two transverse strips of a sealing coating along two transverse edges and two longitudinal strips of sealing coating extending on either side of the article to be packaged and perpendicular to the transverse strips in the regions of formation of the twists at a distance from the longitudinal edges of the foil, the ends of the transverse strips being spaced from the longitudinal edges a distance corresponding to the distance the longitudinal strips are spaced from the longitudinal edges, the process comprising:

depositing the article between the transverse strips and between the longitudinal strips on a side of the foil having said strips to leave excess film extending beyond the article:

raising the two transverse edges substantially vertically;

positioning the two transverse edges proximate one another on top of the article;

sealing the transverse edges to one another by the two transverse strips;

folding the two transverse edges thus sealed back over the article; and twisting the excess film in the area of the longitudinal strips to form two twists.

2. The process according to claim 1, wherein the operation of folding and of sealing the transverse edges above the article is carried out as a continuous operation between sealing of jaws of a press.

3. A packaging wrapper comprising a film which can be cut into separate foils, each foil sized to be closed by two twists on either side of an article to be packaged, the film including on one side and on each foil two longitudinal strips of sealing coating and two transverse strips of sealing coating, the two transverse strips extending between the longitudinal strips along two transverse edges of the foil, the two longitudinal strips extending on either side of the article to be packaged and perpendicular to the transverse strips in the regions of formation of the twists at a distance from the longitudinal edges of the foil, the ends of each transverse strip being spaced from the longitudinal edges a distance corresponding to the distance the longitudinal strips are spaced from the longitudinal edges.

4. A wrapper according to claim 3, wherein the coatings are a cold-sealing coating.

5. A wrapper according to claim 3, wherein the coatings are a heat-sealing coating.

6. A wrapper according to claim 3, wherein the two longitudinal strips are of cold-sealing coating and the two transverse strips are of heat-sealing coating.

7. A wrapper according to claim 3, wherein the two longitudinal strips are of heat-sealing coating and the two transverse strips are of cold-sealing coating.

8. A wrapper comprising a film which can be cut into separate foils, each foil to be closed by two twists on the sides of an article to be packaged, the film including on one side and each foil, two longitudinal strips of sealing coating, and two transverse strips of sealing coating extending perpendicularly to the longitudinal strips along two transverse edges of the foil, the longitudinal strips being spaced at a distance from the longitudinal edges, the ends of the transverse strips being spaced from the longitudinal edges and extending between the longitudinal strips, wherein the two transverse strips are of cold-sealing coating.

9. A wrapper according to claim 8, wherein the coatings are a cold-sealing coating.

10. A wrapper according to claim 8, wherein the two longitudinal strips are of heat-sealing coating and the two transverse strips are of cold-sealing coating.

* * * * *

UNITED STATES PATENT AND TRADEMARK OFFICE

CERTIFICATE OF CORRECTION

PATENT NO. : 6,374,583 B1
DATED : April 23, 2002
INVENTOR(S) : Daelmans et al.

It is certified that error appears in the above-identified patent and that said Letters Patent is hereby corrected as shown below:

Column 6,
Line 40, after "coating" insert -- extending along the length of the foil, --
Line 48, after "the", delete "coatings", and insert -- longitudinal strips --
Line 51, after "coating", delete "and the two transverse strips are of cold-sealing coating"

Signed and Sealed this

Third Day of September, 2002

*Attest:*

*Attesting Officer*

JAMES E. ROGAN
*Director of the United States Patent and Trademark Office*